US009850060B2

(12) United States Patent
Freudenberg et al.

(10) Patent No.: US 9,850,060 B2
(45) Date of Patent: Dec. 26, 2017

(54) MULTIPLE SOLID PRODUCTS LIQUID SOLUTION DISPENSER

(71) Applicant: Ecolab USA Inc., Saint Paul, MN (US)

(72) Inventors: Jared R. Freudenberg, Saint Louis Park, MN (US); Ryan Jacob Urban, Mahtomedi, MN (US)

(73) Assignee: Ecolab USA Inc., St. Paul, MN (US)

( * ) Notice: Subject to any disclaimer, the term of this patent is extended or adjusted under 35 U.S.C. 154(b) by 384 days.

(21) Appl. No.: 14/452,074

(22) Filed: Aug. 5, 2014

(65) Prior Publication Data

US 2016/0039597 A1 Feb. 11, 2016

(51) Int. Cl.
*B65D 83/38* (2006.01)
*B01F 1/00* (2006.01)

(52) U.S. Cl.
CPC ..... *B65D 83/38* (2013.01); *B01F 1/0027* (2013.01)

(58) Field of Classification Search
CPC ..... B65D 83/38; B01F 1/0027
See application file for complete search history.

(56) References Cited

U.S. PATENT DOCUMENTS 4,438,534 A * 3/1984 Keyes ..... A47L 15/4436 4/227.7
5,194,230 A * 3/1993 PeKarna ..... A47L 15/4436 211/50
5,782,109 A * 7/1998 Spriggs ..... A47L 15/4418 68/17 R
7,597,861 B2 10/2009 Thomas et al.
7,658,844 B2 * 2/2010 Blanchette ..... C02F 1/688 210/167.11
8,075,847 B2 12/2011 Zettlitzer et al.
2005/0244315 A1 11/2005 Greaves et al.
2011/0165034 A1 * 7/2011 Carlson ..... B67D 7/08 422/261
2012/0241045 A1 9/2012 Aouad
2012/0320706 A1 * 12/2012 Sanville ..... B01F 1/0027 366/182.1
2013/0216450 A1 8/2013 Carroll
2014/0056097 A1 2/2014 Sanville et al.
2014/0233346 A1 8/2014 Schultz

OTHER PUBLICATIONS

U.S. Appl. No. 14/061,817, entitled "Single Piece Three-Way Elastomeric Valve," filed Oct. 24, 2013, 27 pages.
International Patent Application No. PCT/US2015/042972, International Search Report and Written Opinion dated Oct. 20, 2015, 8 pages.

* cited by examiner

*Primary Examiner* — Regina M Yoo
(74) *Attorney, Agent, or Firm* — Fredrikson & Byron, P.A.

(57) ABSTRACT

A dispenser system and method for creating and dispensing one or more solutions formed from a plurality of separate and distinct solid products which are eroded or dissolved in a liquid. The one or more solutions may include at least one of a first solid product and a second solid product, dissolved in the liquid. The dispenser system may include one or more dividers within a solution forming assembly of the dispenser system to maintain separation between the first solid product and the second solid product.

17 Claims, 5 Drawing Sheets

MULTIPLE SOLID PRODUCTS LIQUID SOLUTION DISPENSER

BACKGROUND

Solutions formed from dissolving a solid product in a liquid are known and have been utilized in various applications. Accordingly, solution-forming devices have been developed in order to create desired solutions without the need to manually create them. A liquid is supplied to the device to erode or dissolve a solid product, the solution is formed therein and then flows out of the device. Such devices may be used to create cleaning and sanitizing solutions or other desired solutions.

SUMMARY

Embodiments of the present invention relate to methods and apparatuses for the formation of a solution between a solid product (e.g., solid block of chemistry) and a liquid (e.g., fluid) in contact with the solid product. More particularly, but not exclusively, the present invention relates to methods and apparatuses for forming liquid solutions from a plurality of solid products and a liquid to erode or dissolve the solid product(s).

In at least one embodiment, a dispenser system for creating liquid solutions from either or both of a first solid product and a separate and distinct second solid product, wherein the liquid solutions include at least a first solution and a second solution. The dispenser system including an inlet portion configured to introduce the liquid into the dispenser system, a solution forming assembly, and an outlet portion configured to dispense liquid solutions.

The solution forming assembly may include a support structure configured to support the first and second solid products and a reservoir operatively coupled to the support structure. The reservoir being configured to hold the liquid and the first and second solutions, and to allow the flow of the liquid into the reservoir, and the first and second solutions out of the reservoir. The reservoir may be positioned proximate the support structure such that the liquid may confront and dissolve the first solid product when the liquid is held in the reservoir and such that the liquid may confront and dissolve the second solid product when the liquid is held in the reservoir. The solution forming assembly may be configured to hold and maintain separation between the first solid product and the second solid product, and to form the first solution and the second solution, wherein the first solution and the second solution have different chemical compositions.

In at least one other embodiment, a dispenser system for creating one or more solutions by dissolving either or both of a first solid product and a separate and distinct second solid product, in a liquid may include: a housing, an inlet portion configured to introduce the liquid into the dispenser system, a solid product guide configured to accept insertion of the first and second solid products into the dispenser system, a solution forming assembly being at least partially within the housing, and an outlet portion configured to dispense the one or more solutions, wherein the one or more solutions comprise at least one of the first solid product dissolved in the liquid and the second solid product dissolved in the liquid.

The solution forming assembly may include a support structure configured to support the first and second solid products, a reservoir proximate to the support structure configured to hold the liquid, and the one or more solutions and to allow flow of the liquid into the reservoir and the one or more solutions out of the reservoir. The solution forming assembly may also include one or more dividers within the solution forming assembly to maintain separation between the first solid product and the second solid product.

In one or more embodiments of a method for creating one or more liquid solutions from either or both of a first solid product and a separate and distinct second solid product, the method may include: providing a dispenser system such as the dispenser systems described above, introducing the liquid into the reservoir to dissolve the solid product in the liquid to create the one or more solutions, and dispensing the solution via the outlet portion.

In some embodiments of the method, the one or more solutions comprises the first solid product dissolved in the liquid and the second solid product dissolved in the liquid. In one or more embodiments of the method the step of introducing the liquid into the reservoir may include introducing the liquid into the reservoir such that the first solid product is eroded and introduced into the solution at a first concentration and the second solid product is eroded and introduced into the solution at a second concentration, the first concentration and second concentration may be different.

Apparatuses for and methods of dispensing a solution formed from dissolving a solid product within a liquid fluid fall within the scope of the present invention. The details of one or more examples and embodiments of the invention are set forth in the accompanying drawings and the description below. Other features, objects, and advantages will be apparent from the description and the drawings, as well as from the claims of the invention.

DETAILED DESCRIPTION

The present invention is aimed at creating easy-to-use, cost-effective and repeatable solutions. Embodiments of the invention are designed to dispense a solution formed from a plurality of solid product and an incident liquid such as water. The solid products may comprise many different products, including but not limited to, a sanitizer, a detergent, or a floor care product, as many applications of the present invention may involve creating a solution for a cleaning process. In some uses, one of the plurality of solid products may act as a catalyst to one or more other solid products. In many cases, it is desirable to erode the solid products evenly and consistently to achieve and maintain a certain concentration of a solution for cost, performance, or even regulatory reasons. In other cases, it may be desirable to modify the chemistry of the solution dispensed, such as to add another chemistry to the solution, vary the concentration of one of the solid products, or have the option to dispense a solution including less than all of the solid products present in the dispenser.

Figure 1:
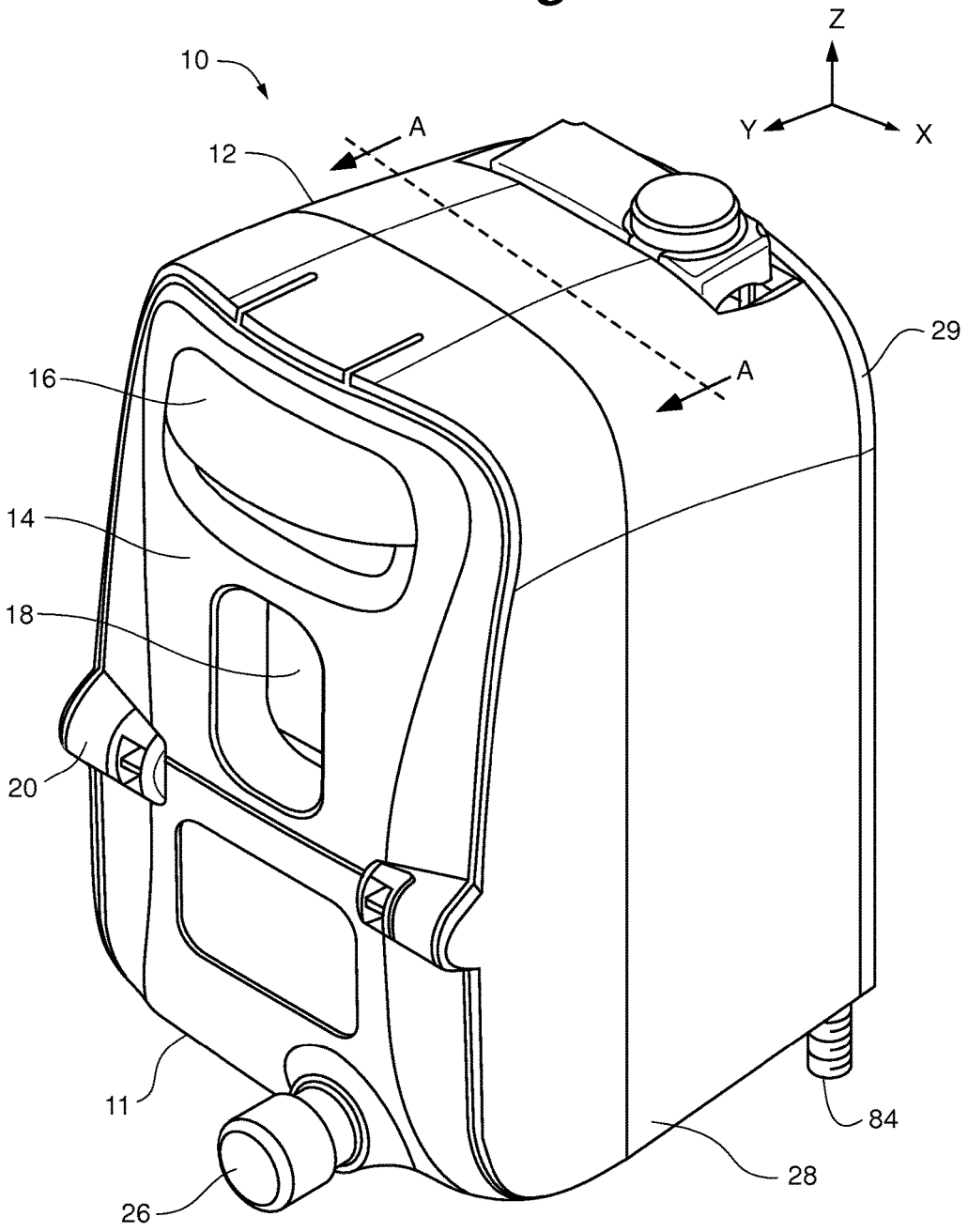
FIG. 1 depicts a perspective view of an embodiment of a dispenser system described herein.

FIG. 1 shows an exemplary embodiment of a dispenser system 10 for use with the present invention. However, it should be noted that other types and configurations of dispensers may be used with the invention, and the description and figures of the dispenser system 10 are not to be limiting. The dispenser system 10 is configured to hold a plurality of solid products that may be combined with a liquid, such as water, to create a solution. For example, one or more of the solid products may be mixed with the liquid (e.g., fluid) to create a cleaning detergent. The dispenser system works by having the liquid interact with the solid product to form a solution having a desired concentration for its end use application. The liquid may be introduced to a bottom, side, or other suitable surface of the solid product, directly or indirectly.

The dispenser system 10 of the present disclosure includes features that result in increased flexibility in the chemistry composition of the solutions to be dispensed by the dispenser system 10. The novel apparatus includes a dispenser system 10 capable of eroding a plurality of different solid products. The plurality of solid products may be kept separate (e.g., by dividers) from each other until being dissolved in the liquid to form the solution within the dispenser. In addition, the novel apparatus and methods provide the ability for each different solid product to be eroded at different rates, be eroded by different levels of turbulence or agitation and/or be introduced into the solution in different concentrations. The dispenser system further provides the ability to introduce solid products that must be kept separate from one another until immediately before the solution is used, as is the case when one of the solid products works as a catalyst with another solid product. In some embodiments, the dispenser system may be capable of housing a plurality of solid products, but prevent dispensing a solution including one or more of the solid products, while dispensing a solution including one or more other solid products. Thus, a single dispenser system of the present invention may produce a variety of solutions.

The solutions may be formed within the dispenser system 10, and although not a requirement of the present invention, the solutions may be formed within a reservoir 60 of a solution forming assembly 30 of the dispenser system 10 (the reservoir 60 and other components of the solution forming assembly 30 are inside the housing 12 and are not viewable in FIG. 1, see FIGS. 2-6). The liquid flow may interact with the solid product in the reservoir 60, or anywhere else in the dispenser system 10, to create the solution. Features of the present disclosure may provide increased flexibility in the solid products that can be used in the dispenser system 10, and the solutions that may be produced by the dispenser system 10. In other words, the present disclosure may be used to provide a greater variety of solutions and flexibility for the user.

According to the exemplary embodiment, the dispenser system 10 of FIG. 1 includes a housing 12 comprising a front door 14 having a handle 16 thereon. The front door 14 may be hingeably connected to a front fascia 11 via hinges 20 therebetween. This allows the front door 14 to be rotated about the hinge 20 to allow access into the housing 12 of the dispenser system 10. For example, the front door 14 includes a window 18 therein to allow an operator to view the solid products housed within the housing 12. Once the housed product has been viewed to erode to a certain extent, the front door 14 can be opened via the handle 16 to allow an operator to replace the solid product with a new un-eroded product.

Mounted to the front fascia 11 is one or more buttons 26 for activating the dispenser system 10. The button 26 may be a spring-loaded button such that pressing or depressing of the button 26 activates the dispenser system 10 to discharge an amount of solution created by the solid product and the liquid, or provide the option to adjust the chemistry composition of the solution. The button 26 may be preprogrammed to dispense a desired amount per pressing of the button 26, or may continue to discharge an amount of solution while the button 26 is depressed.

Connected to the front fascia 11 is a rear enclosure 28, which generally covers the top, sides and rear of the dispenser system 10. The rear enclosure 28 may also be removed to access the interior of the dispenser system 10. A mounting plate 29 may be positioned at the rear of the dispenser system 10 and includes features for mounting the dispenser system 10 to a wall or other structure, if desired. For example, the dispenser system 10 may be attached to a wall via screws, hooks, or any other suitable mounting device. The components of the housing 12 of the dispenser system 10 may be molded plastic, metal, a combination of materials, or any other suitable material.

Figure 2:
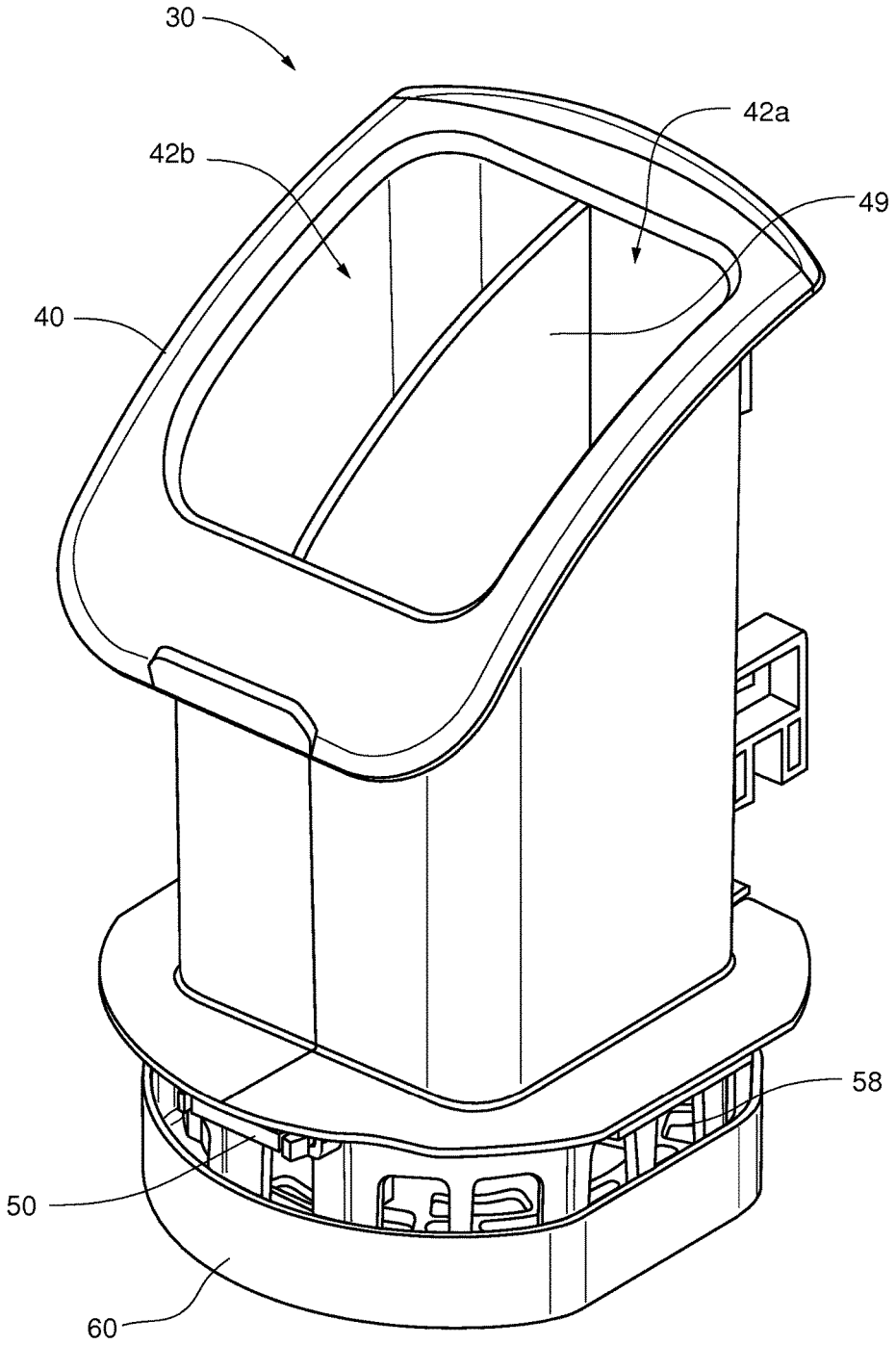
FIG. 2 depicts a perspective view of a solution forming assembly of the embodiment of the dispenser system FIG. 1.

FIG. 2 depicts an illustrative embodiment of the solution forming assembly 30 which may be utilized and located (at least partially) within housing 12 of the dispenser system 10 of FIG. 1. FIG. 2 depicts an assembled view of the solution forming assembly 30, including a solid product guide 40 for guiding and holding the plurality of solid products to be dissolved; a solid product support structure 50 (referred to herein as support structure 50) for supporting the plurality of solid products while allowing one or more of the solid products to be dissolved by liquid in contact with the solid product(s), for example, via interaction with the liquid in the reservoir. The reservoir 60 is configured to hold the liquid and may provide the space in which components of the solution may be formed, held, or passed through and out of the reservoir 60 via overflow ports 58. The reservoir 60 may be configured to hold the liquid and the one or more solutions and to allow flow of the liquid into the reservoir 60 and the one or more solutions out of the reservoir 60.

The solution forming assembly 30 of FIG. 2 is configured to accept plurality of solid products and can be used with various dispenser systems having various liquid flow paths and dissolving mechanisms including gravity-fed dispenser systems (a liquid flows over the solid product by gravity and erodes the product), spray nozzle-based erosion systems, or by the solid product and liquid being in contact with each other in the reservoir 60, etc. Examples of some dispenser systems and features of dispenser systems that may be used with the present disclosure include the dispenser systems disclosed in United States Patent Application Publication 2013/0216450 to Carroll et al., titled "Controlled Dissolution Solid Product Dispenser", filed Feb. 20, 2013, and Unpublished U.S. patent application Ser. No. 14/182,344 to Schultz et al. titled "Method and Apparatus for Variation of Flow to Erode Solid Chemistry", filed Mar. 6, 2014, which are incorporated by reference, in their entirety, herein. The afore-mentioned dispensers do not include an exhaustive list of suitable dispensers, but merely provide examples of dispensers that include features that may be used in combination with the features of the present invention. For example, the variation of flow features disclosed in U.S. application Ser. No. 14/182,344, may be incorporated into the present invention such that the flow to each of the plurality of solid products may be adjusted independently, separately, concurrently, equally, or simultaneously.

Figure 3:
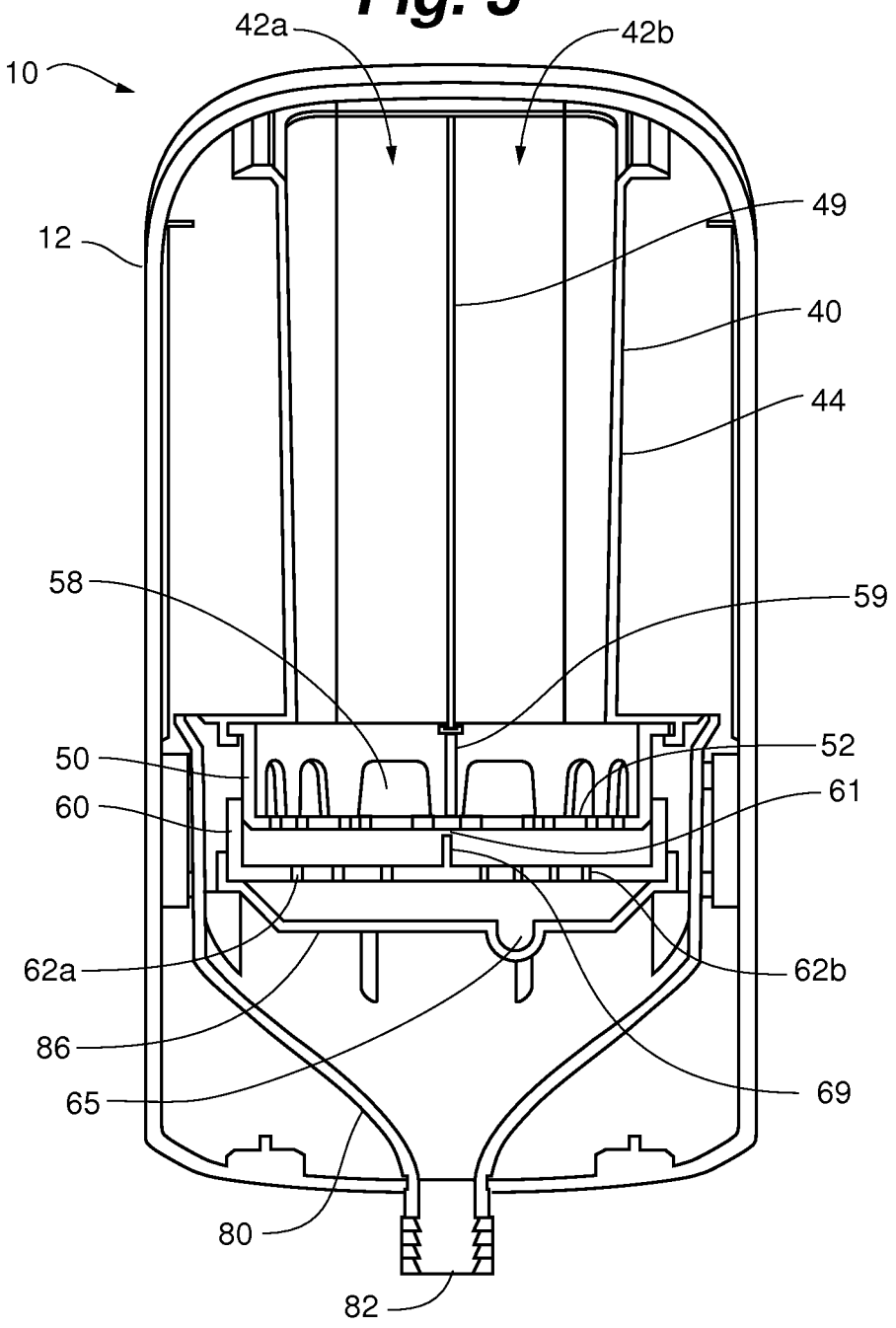
FIG. 3 depicts a cross-sectional view of the dispenser system of FIG. 1, taken at line A-A.
Figure 4:
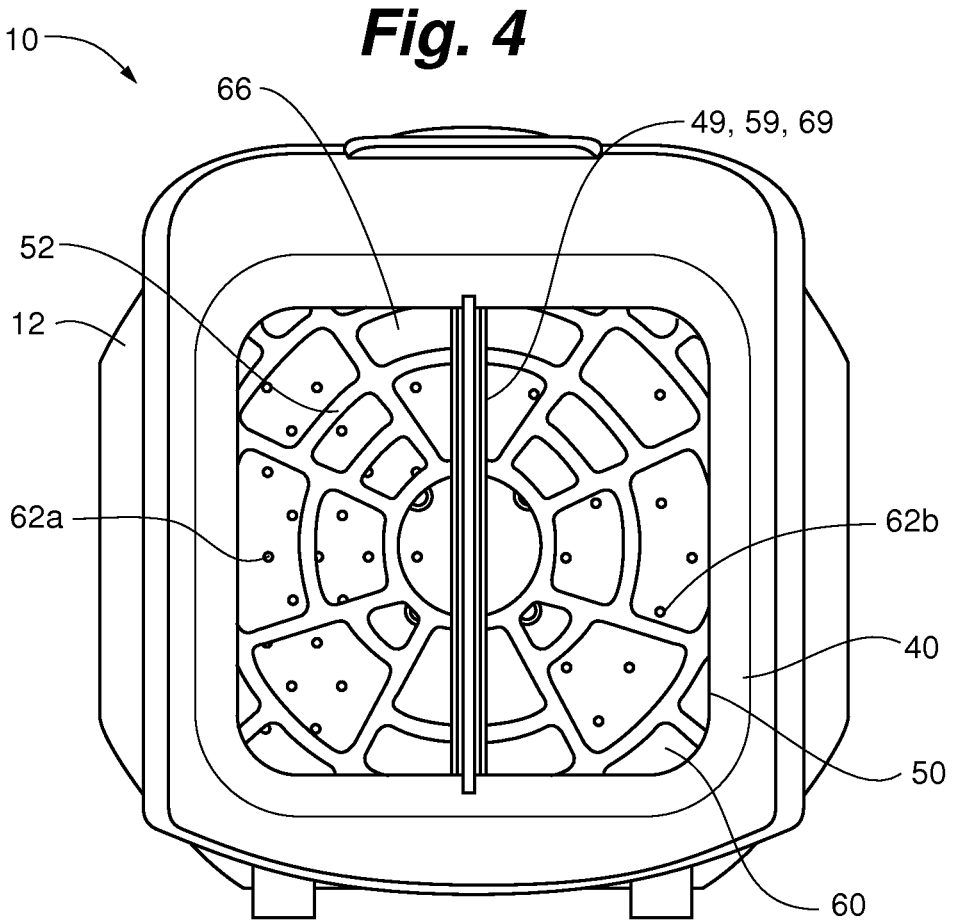
FIG. 4 depicts a top view of the embodiment of FIG. 1.

FIG. 3 depicts a cross-sectional view along line A-A, and FIG. 4 depicts a top view of the exemplary embodiment of the dispenser system 10 of FIG. 1. The solid product guide 40, including walls 44, may guide and/or surround all or a portion of the solid products to be dissolved, into place within housing 12. In other words, the solid product guide 40 may be configured to accept insertion of the plurality of solid products into the dispenser 10. Each of the plurality of solid products may be guided into separate cavities 42*a* and 42*b* within the solid product guide 40. The cavities 42*a*, 42*b* may be keyed (e.g., sized or shaped different from each other) to prevent insertion of the wrong solid product into the wrong cavity. The solid products may be kept separate from each other (e.g., preventing or limiting contact, preventing or limiting chemical interaction, be isolated from one another) by one or more solid product guide dividers 49. In other words, the solution forming assembly 30 may be configured to hold and maintain separation between a plurality of products (e.g., a first solid product and a second solid product, etc.).

Figure 5:
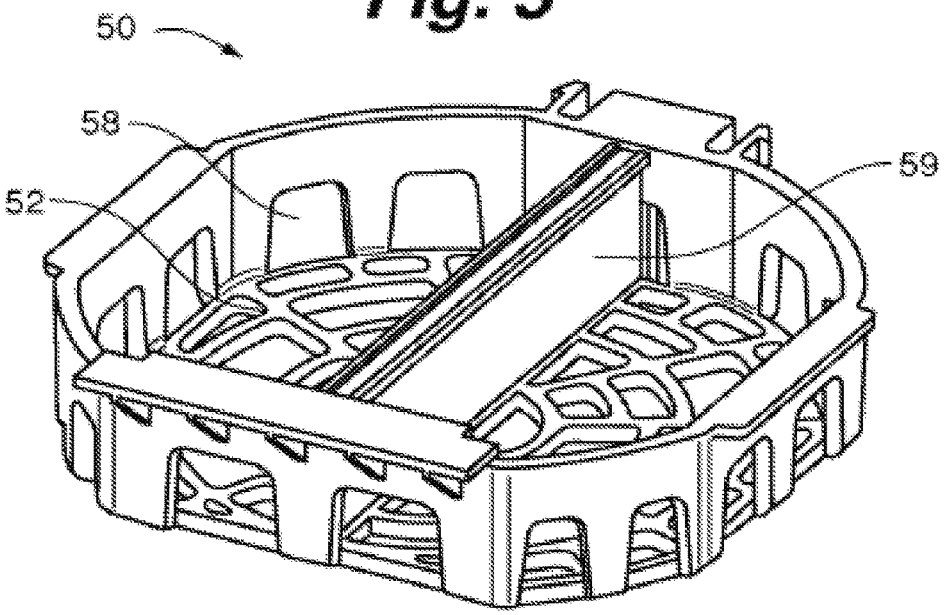
FIG. 5 depicts a perspective view of one embodiment of a support structure of the solution forming assembly of the dispenser system of FIG. 1.

Any of the solid products may rest on the support structure 50, which as depicted, may include grate 52 (See, FIGS. 4 and 5). The support structure 50 may further include one or more support structure dividers 59, to separate one or more of the solid products from each other. FIG. 5 depicts the support structure 50 of the illustrative embodiment of FIG. 2 in further detail. The support structure 50 may be in the form of a molded plastic component, but may also include interlocking wires, a metal stamped or casted component, ceramics, a combination of such materials, or any other suitable support structure that is configured to support the solid product in contact with the liquid to form a solution. The support structure 50 may be a component separate from the solid product guide 40 and the reservoir 60, or the features may be integrated into one or more adjacent components of the dispenser system 10.

As depicted in FIGS. 2-4 and 6, the solution forming assembly 30 may include the reservoir 60. As particularly depicted in FIG. 6, the reservoir 60 may be formed by the sidewall portions 64 and base portion 66 such that the reservoir 60 is configured to contain or hold the liquid and/or a plurality of solutions (e.g., a first solution, a second solution, etc.) and to allow the flow of liquid into the reservoir and the plurality of solutions out of the reservoir 60. The sidewall portions 64 of reservoir 60 may extend upward and away from the base portion 66 at an angle (e.g., an angle greater than 0 degrees, generally extending upward at around 90 degrees). Sidewall portions 64 may have an internal surface facing the inside of the reservoir 60 and an opposite external surface facing out of the reservoir 60. The sidewall portions 64 may define the perimeter of the reservoir 60.

In the embodiment of dispenser system 10 of FIGS. 3-4, the solution is formed when a portion or portions of the solid product(s) adjacent to (e.g., supported by) the support structure 50 come into contact with the liquid (e.g., fluid flow) in the reservoir 60. In some embodiments, the reservoir 60 may be positioned proximate the support structure 50 such that the liquid confronts and dissolves the first solid product when the liquid is held in the reservoir 60 and the liquid confronts and dissolve the second solid product when the liquid is held in the reservoir 60. For example, the geometric relationship of the support structure 50 and the reservoir 60 may be such that the support structure 50 extends into the internal cavity 70 (See, FIG. 6) of the reservoir 60 while a gap 61 is maintained between the base portion 66 of the reservoir 60 and the support structure 50. The mixing of the liquid and solid product erodes the solid products and dissolves portions of the solid products in the liquid to form a liquid solution within the reservoir 60. The solution continues to rise in the reservoir 60 until it reaches the level of one or more overflow ports 58, which may be determined by the height of the sidewall portions 64. However, the overflow ports 58 do not have to be defined by the geometry of the reservoir 60, but may be incorporated into other components of the dispenser system 10. For example, the overflow ports 58 may be formed by the reservoir 60 in combination with additional components such as the support structure 50. The solution passes through the overflow port(s) 58 and into the collection zone 80, which is depicted as a funnel in FIG. 3, but may be any suitable collection zone 80. From the collection zone 80, the solution exits the dispenser system 10 via outlet portion 82 which is configured to dispense liquid solutions. At this stage, the solution may be used in a desired application.

In one or more embodiments, to form the solution, a liquid, such as water or any other suitable fluid, may be provided to the dispenser system 10 via an inlet portion 84. As shown in FIG. 1*a*, the inlet portion 84 (FIG. 1*a*) is connected to the button 26 such that pressing the button 26 will pass liquid into the dispenser system 10 to come in contact with one or more of the plurality of solid products. For example, in the exemplary dispenser system 10 of FIG. 3, the liquid may pass from the inlet portion 84 into the reservoir 60 via one or more liquid inlets 62*a*, 62*b* formed in the base 66 of the reservoir 60. The liquid may be routed from the inlet portion 84, to a liquid supply device 65 in manifold 86 via one or more tubes. Tubes connecting the inlet portion 84 and the liquid supply device 65 are not depicted, but are conventional in the art and would be known to one of ordinary skill in the art. The liquid supply device 65 may further deliver liquid to the reservoir liquid inlets 62*a*, 62*b*, but any suitable arrangement for bringing the liquid and the solid product into contact with one another may be used. The exemplary dispenser system 10 depicts only one apparatus and method for forming a solution, and is not intended to be limiting in scope of the dispenser systems with which the plural solid product chemistry features may be used. The liquid used to dissolve or erode the solid product may be provided to the dispenser system 10 by a house water source, for example, tap water, but may also be further pressurized, or may be recirculated liquid (e.g., recycled). For example, the recirculated liquid may be previously dispensed liquid that has been filtered and boosted with additional cleaning agent in the dispenser before being dispensed for use as a solution again. The dispenser system 10 may be open to the atmosphere and operate at atmospheric pressure, or be a closed and/or pressurized system.

Figure 6:
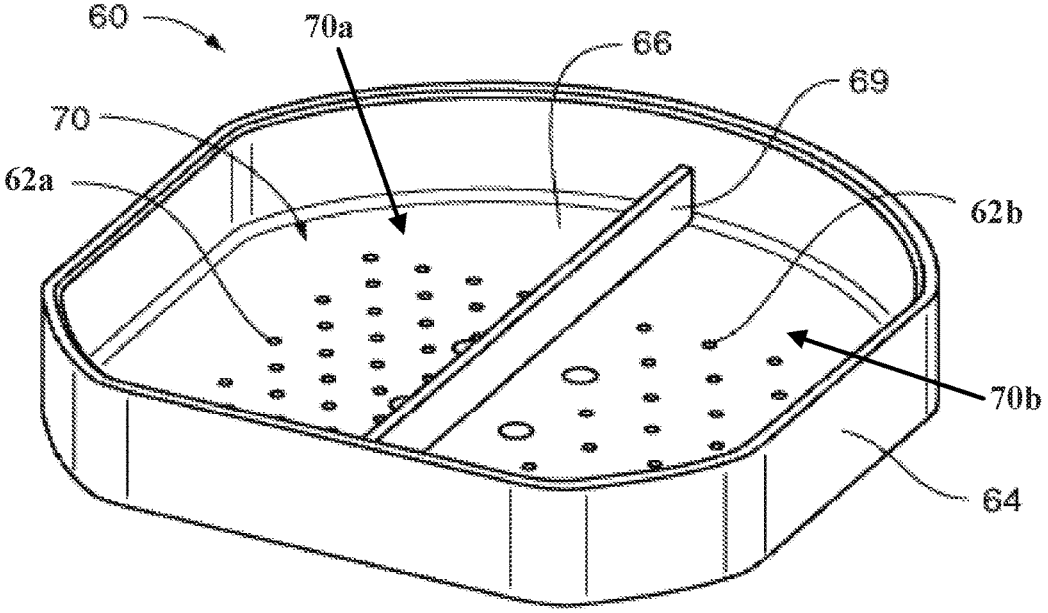
FIG. 6 depicts a perspective view of one embodiment of a reservoir of the solution forming assembly of the dispenser system of FIG. 1.

As depicted in FIGS. 3 and 6, the reservoir 60 may be divided by one or more reservoir dividers 69 into one or more reservoir portions such as first reservoir portion (70*a*) and second reservoir portion (70*b*). The first reservoir portion hold and allow flow of at least a portion of the solution including at least a portion of the first solid product, and a second reservoir portion to hold and allow flow of at least a portion of the solution including at least a portion of the second solid product. The solutions formed in each reservoir portion 70*a*, 70*b* may not mix until after leaving the reservoir 60. For example, the first and second portions of the reservoir 70*a*, 70*b*) may be fluidly isolated from one another (e.g., completely, totally, partially, substantially, or generally isolated from one another), with the majority of the solution mixing or co-mingling occurring after the solutions exit reservoir 60 via overflow ports 58. For example, the mixing could occur in the collection zone 80 (FIG. 3), rather than or in addition to occurring in the reservoir 60.

With respect to the dispenser system 10 of FIGS. 1-6, a variety of component arrangement and dispensed solutions may be produced. For example, in some embodiments, dispenser system 10 may create liquid solutions from either or both of a first solid product and a separate and distinct second solid product being supported by the support structure. The first and second solid products may be used to create a first solution and a second solution. The first solution and the second solution (or any other number of solutions) may have chemical compositions different from each other. In some embodiments, one of the solutions dispensed may include only the first solid product or the second solid product (e.g., only, substantially only).

In some embodiments, the first solution includes at least a portion of either the first or second solid products, dissolved in the liquid, while the second solution includes at least a portion of both of the first and second solid products, dissolved in the liquid. In one or more embodiments, the concentration of the first solid product in the second solution, and the concentration of the second solid product in the second solution, are different from each other.

FIG. 4 depicts a top view of the embodiment of the dispenser system of FIG. 1. Looking down into the solution forming assembly 30 (which may include product guide 40, support structure 50 and reservoir 60), liquid inlets 62*a*, 62*b* are shown in reservoir 60. In some embodiments, liquid inlets 62*a* and 62*b* may be separated by the one or more reservoir dividers 69, as further depicted in FIG. 6. In some embodiments, liquid inlets 62*a* and 62*b* may be sized, positioned, numbered and generally arranged such that different liquid flow characteristics are provided via the first liquid inlet 62*a* versus the second liquid inlet 62*b*. As shown, liquid inlets 62*a* are larger and more densely spaced, while liquid inlets 62*b* are smaller and less densely spaced, resulting in different liquid flow characteristics. The different liquid flow characteristics or schemes may provide different erosion rates or patterns that result in different concentrations of the one or more solid products in the formed solution. For example, in the case where one solid product is harder to erode than another, different flow characteristics via liquid inlets 62*a* and 62*b* may be used to result in a solution with equal concentrations of the one or more solid products in the formed solution. In other words, a more aggressive flow on a relatively hard solid product may result in substantially the same amount or concentration being eroded as a less aggressive flow on a different and separate softer solid product. In other words, the solution forming assembly 30 (and the liquid inlets 62*a*, 62*b* in particular) may be configured to erode the first solid product at a different rate (e.g. at a faster or different flow rate) than the second solid product. Although first and second solid products are described in the following disclosure, any number of solid products having similar or dissimilar rates of erosion to one another is within the scope of this disclosure. Any number of solid products, and any combination of erosion characteristics or dispenser system 10 features as described herein, is considered to fall within the scope of this disclosure.

In one or more embodiments the first liquid inlet 62*a* is configured to erode the first solid product at a first rate of erosion, and a second liquid inlet is configured to erode the second solid product at a second rate of erosion, the first rate of erosion and second rate of erosion may be different.

In one or more embodiments, the first liquid inlet 62*a* includes an first aperture (e.g., first set of apertures) extending from an external surface of the reservoir 60 to an internal surface of the reservoir 60, and a second liquid inlet 62*b* includes a second aperture (e.g., second set of apertures) extending from an external surface of the reservoir 60 to an internal surface of the reservoir 60. The first aperture may be different from the second aperture.

In one or more embodiments, the reservoir comprises a first plurality of liquid inlets 62*a* having a total first liquid inlet area, and a second plurality of liquid inlets 62*b* having a total second liquid inlet area, wherein the total first liquid inlet area is greater than the total second liquid inlet area.

In one or more embodiments, the reservoir comprises a first plurality of liquid inlets 62*a* having a first inlet density spacing, and a second plurality of liquid inlets 62*b* having a second inlet density spacing, wherein the first inlet density spacing is different from the second inlet density spacing.

Any suitable combination of flow and concentration characteristics, applied to any number of solid products, may be provided, as desired, based on the solid products and the intended solution(s) to be dispensed.

An exemplary method for creating one or more liquid solutions from either or both of a first solid product and a separate and distinct second solid product using the dispenser system 10 of FIGS. 1-6 may include: providing a dispenser system 10 including an inlet portion configured to introduce the liquid into the dispenser system 10, a solid product guide 30 configured to accept insertion of the first and second solid products into the dispenser system 10, a solution forming assembly 30, and an outlet portion 82 configured to dispense the one or more solutions. The solution forming assembly 30 including a support structure 50 configured to support the first and second solid products, a reservoir 60 proximate to the support structure 50 configured to hold the liquid and the one or more solutions and to allow flow of the liquid into the reservoir 60 and the one or more solutions out of the reservoir 60, and one or more dividers within the solution forming assembly 30 to maintain separation between the first solid product and the second solid product.

The exemplary method further including introducing the liquid into the reservoir 60 to dissolve the solid product in the liquid to create the one or more solutions. In some embodiments, at least one of the one or more solutions comprises the first solid product dissolved in the liquid and the second solid product dissolved in the liquid.

The exemplary method further including dispensing the solution via the outlet portion 82.

The exemplary method further including the step of introducing the liquid into the reservoir including introducing the liquid into the reservoir such that the first solid product is eroded and introduced into the solution at a first concentration and the second solid product is eroded and introduced into the solution at a second concentration such that the first concentration and the second concentration are different.

The methods described above may include any and all the aspects of solutions formed using a plurality of solid products described with regard to the dispenser system 10 described herein. All features described with respect to the dispenser system 10 apparatus may be incorporated into the method of using the dispenser system 10 to create solutions, or any variations or suitable dispenser systems falling within the scope of the features described herein.

Various embodiments of the invention have been described. It should be known that the embodiments described herein are exemplary in nature and in no way limit the scope of the invention. Rather, they serve as examples illustrating various features and embodiments thereof. These and other embodiments are within the scope of the following claims.

What is claimed is:

1. A dispenser system for creating one or more solutions by dissolving either or both of a first solid product and a separate and distinct second solid product, in a liquid, the dispenser system comprising:

a housing;

an inlet portion configured to introduce the liquid into the dispenser system;

a solid product guide configured to accept insertion of the first and second solid products into the dispenser system;

a solution forming assembly being at least partially within the housing and including:

a support structure configured to support the first and second solid products;

a reservoir proximate to the support structure configured to hold the liquid and the one or more solutions and to allow flow of the liquid into the reservoir and the one or more solutions out of the reservoir, wherein the reservoir has a base from which a divider extends out, the divider forming a first reservoir portion and a second reservoir portion, the first reservoir portion comprising a first plurality of liquid inlets in the base having a total first liquid inlet area, the second reservoir portion comprising a second plurality of liquid inlets in the base having a total second liquid inlet area that is less than the total first liquid inlet area; and an outlet portion configured to dispense the one or more solutions, wherein the one or more solutions comprise at least one of the first solid product dissolved in the liquid and the second solid product dissolved in the liquid.

2. The dispenser system of claim 1, wherein the reservoir is configured to confront and dissolve the first solid product when the liquid is held in the first reservoir portion and confront and dissolve the second solid product when the liquid is held in the second reservoir portion.

3. The dispenser system of claim 1, wherein the solution forming assembly is configured to form the one or more solutions dispensed via the outlet portion as comprising at least a portion of both the first and second solid products dissolved in the liquid, and wherein the solution forming assembly is configured to form the one or more solutions dispensed via the outlet portion with a concentration of the first solid product in the dispensed solution that is different from a concentration of the second solid product in the dispensed solution.

4. The dispenser system of claim 1, wherein the solution forming assembly is configured to dispense via the outlet portion the solution comprising only the first solid product or only the second solid product.

5. The dispenser system according to claim 1, wherein the solid product guide comprises one or more dividers to separate the first solid product from the second solid product.

6. The dispenser system according to claim 1, wherein the support structure comprises a divider aligned with the divider of the reservoir.

7. The dispenser system according to claim 1, wherein the first solid product and the second solid product are separated from contact with each other in the solid product guide, the support structure and the reservoir of the solution forming assembly.

8. The dispenser system according to claim 1, wherein the first and second reservoir portions are fluidly isolated from one another.

9. The dispenser system of claim 1, wherein the first plurality of liquid inlets comprise first apertures extending from an external surface of the base to an internal surface of the base, and the second plurality of liquid inlets comprise second apertures extending from the external surface of the base to the internal surface of the base, and wherein the divider is configured to fluidly isolate the first reservoir portion from the second reservoir portion along the internal surface of the base.

10. The dispenser system of claim 1, wherein the first plurality of liquid inlets have a first inlet density spacing and the second plurality of liquid inlets have a second inlet density spacing, wherein the first inlet density spacing is different from the second inlet density spacing.

11. A dispenser system for creating liquid solutions from either or both of a first solid product and a separate and distinct second solid product dissolved in a liquid, wherein the liquid solutions comprise at least a first solution and a second solution, the dispenser system comprising:

an inlet portion configured to introduce the liquid into the dispenser system;

a solution forming assembly comprising:

a support structure configured to support the first and second solid products;

a reservoir operatively coupled to the support structure, and configured to hold the liquid and the first and second solutions and to allow the flow of the liquid into the reservoir and the first and second solutions out of the reservoir, wherein the reservoir has a base from which a divider extends out, the divider forming a first reservoir portion and a second reservoir portion, the first reservoir portion comprising a first plurality of liquid inlets in the base having a total first liquid inlet area, the second reservoir portion comprising a second plurality of liquid inlets in the base having a total second liquid inlet area that is less than the total first liquid inlet area, wherein the reservoir is positioned proximate the support structure such that the liquid confronts and dissolves the first solid product when the liquid is held in the first reservoir portion and such that the liquid confronts and dissolves the second solid product when the liquid is held in the second reservoir portion;

wherein the solution forming assembly is configured to form the first solution and the second solution, wherein the first solution and the second solution have different chemical compositions; and an outlet portion configured to dispense the liquid solutions.

12. The dispenser system of claim 11, wherein the solution forming assembly is configured to form the first solution as comprising at least a portion of either the first solid product or at least portion of the second solid product, dissolved in the liquid, and the second solution as comprising at least a portion of both of the first solid product and the second solid product, dissolved in the liquid.

13. The dispenser system of claim 11, wherein the solution forming assembly is configured to form the second solution with a concentration of the first solid product in the second solution that is different from a concentration of the second solid product in the second solution.

14. The dispenser system of claim 11, wherein the solution forming assembly is configured to erode the first solid product at a faster rate than the second solid product.

15. The dispenser system of claim 11, wherein a base of the support structure is configured to support the first and second solid products, and wherein the base of the support structure extends into an internal cavity of the reservoir including the first reservoir portion and the second reservoir portion.

16. The dispenser system of claim 11, wherein the support structure comprises a divider aligned with the divider of the reservoir.

17. The dispenser system of claim 11, wherein the divider is configured to fluidly isolate the first reservoir portion from the second reservoir portion along an internal surface of the base.

* * * * *